US009201383B2

(12) United States Patent
Yokoi et al.

(10) Patent No.: US 9,201,383 B2
(45) Date of Patent: Dec. 1, 2015

(54) IMAGE FORMING APPARATUS HAVING EXPOSING UNIT POSITIONING MEMBER

(71) Applicants: Junichi Yokoi, Toyoake (JP); Yosuke Sugiyama, Gifu (JP)

(72) Inventors: Junichi Yokoi, Toyoake (JP); Yosuke Sugiyama, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/223,000

(22) Filed: Mar. 24, 2014

(65) Prior Publication Data

US 2014/0204167 A1 Jul. 24, 2014

Related U.S. Application Data

(63) Continuation of application No. 13/167,454, filed on Jun. 23, 2011, now Pat. No. 8,717,398, which is a continuation of application No. 12/342,496, filed on Dec. 23, 2008, now Pat. No. 7,982,761.

(30) Foreign Application Priority Data

Dec. 27, 2007 (JP) ..... 2007-335771

(51) Int. Cl.
*B41J 15/14* (2006.01)
*B41J 27/00* (2006.01)
(Continued)

(52) U.S. Cl.
CPC ..... *G03G 21/1619* (2013.01); *G03G 15/04036* (2013.01); *G03G 21/1666* (2013.01); *G03G 2215/0141* (2013.01); *G03G 2221/1636* (2013.01)

(58) Field of Classification Search
USPC ..... 347/238, 242, 245, 257, 263
See application file for complete search history.

(56) References Cited

U.S. PATENT DOCUMENTS 5,376,994 A 12/1994 Mama et al.
5,704,810 A 1/1998 Shimasaki
(Continued)

FOREIGN PATENT DOCUMENTS

JP 61-095956 A 5/1986
JP 62-175782 A 8/1987
(Continued)

OTHER PUBLICATIONS

Notification of Reasons for Refusal for corresponding Japanese Application No. 2007-335771 mailed Nov. 22, 2011.
(Continued)

*Primary Examiner* — Hai C Pham
(74) *Attorney, Agent, or Firm* — Banner & Witcoff, Ltd.

(57) ABSTRACT

An image forming apparatus is provided. The image forming apparatus includes: plural photosensitive members; plural exposing units opposed to the photosensitive members, respectively, each of the exposing units including a plurality of light emitting elements arranged in a first direction; and a body frame which is provided at both sides of the exposing units in the first direction. Each of the exposing units includes: a gap maintaining member which abuts a respective one of the photosensitive members to define a distance between the exposing unit and the photosensitive member; a first-direction positioning portion which abuts the body frame in the first direction to position the exposing unit in the first direction; and a second-direction positioning portion which abuts the body frame in a second direction perpendicular to the first direction and an exposing direction of the light emitting elements, to position the exposing unit in the second direction.

20 Claims, 9 Drawing Sheets

(51) Int. Cl.
*G03G 21/16* (2006.01)
*G03G 15/04* (2006.01)

(56) References Cited

U.S. PATENT DOCUMENTS

| | | | | |
|---|---|---|---|---|
| 5,870,659 | A | 2/1999 | Maruyama et al. | |
| 6,538,679 | B2 | 3/2003 | Hiyoshi | |
| 6,545,693 | B2 | 4/2003 | Kitayama et al. | |
| 6,681,088 | B2 | 1/2004 | Kanno et al. | |
| 6,809,752 | B2 | 10/2004 | Nagamine | |
| 6,995,782 | B2 | 2/2006 | Oda et al. | |
| 7,154,525 | B2 | 12/2006 | Oda et al. | |
| 7,589,751 | B2 | 9/2009 | Fukutome et al. | |
| 7,825,946 | B2 | 11/2010 | Sugiyama et al. | |
| 7,982,761 | B2 | 7/2011 | Yokoi | |
| 8,717,398 | B2 * | 5/2014 | Yokoi et al. | 347/242 |
| 2005/0094217 | A1 | 5/2005 | Molchan et al. | |
| 2007/0126852 | A1 | 6/2007 | Fukutome et al. | |
| 2009/0162091 | A1 | 6/2009 | Yokoi | |
| 2009/0169260 | A1 | 7/2009 | Yokoi | |
| 2009/0274488 | A1 | 11/2009 | Sugiyama | |
| 2009/0322851 | A1 | 12/2009 | Yokoi et al. | |

FOREIGN PATENT DOCUMENTS

| | | | |
|---|---|---|---|
| JP | 63-018367 | A | 1/1988 |
| JP | 63-161740 | U | 10/1988 |
| JP | 01-093763 | A | 4/1989 |
| JP | 10-078686 | A | 3/1998 |
| JP | 2000-267033 | A | 9/2000 |
| JP | 2002-031856 | A | 1/2002 |
| JP | 2003-112446 | A | 4/2003 |
| JP | 2004-295147 | A | 10/2004 |
| JP | 2006-088598 | A | 4/2006 |
| JP | 2006-145759 | A | 6/2006 |
| JP | 2007-065125 | A | 3/2007 |
| JP | 2007-069528 | A | 3/2007 |
| JP | 2007-293063 | A | 11/2007 |

OTHER PUBLICATIONS

Office Action received in Japanese Application No. 2008-049324 mailed Mar. 2, 2010.

Communication in Japanese Application No. 2008-049324 mailed Jan. 11, 2011.

Notice of Allowance issued in related U.S. Appl. No. 12/394,795 mailed Dec. 21, 2012.

Final Office Action issued in related U.S. Appl. No. 12/394,795 mailed Apr. 5, 2012.

Non-Final Office Action issued in related U.S. Appl. No. 12/394,795 mailed Aug. 16, 2011.

Notice of Allowance issued in corresponding U.S. Appl. No. 12/394,795 mailed Jul. 22, 2013.

Notice of Allowance issued in U.S. Appl. No. 12/394,795 mailed Nov. 25, 2013.

May 1, 2015—(US) Notice of Allowance—U.S. Appl. No. 14/218,209.

* cited by examiner

IMAGE FORMING APPARATUS HAVING EXPOSING UNIT POSITIONING MEMBER

CROSS-REFERENCE TO RELATED APPLICATION

This application is a continuation of U.S. application Ser. No. 13/167,454, filed on Jun. 23, 2011, which is a continuation of U.S. application Ser. No.: 12/342,496, filed on Dec. 23, 2008, issued as U.S. Pat. No. 7,982,761 on Jul. 19, 2011, which claims priority from Japanese Patent Application No. 2007-335771, filed on Dec. 27, 2007, the entire subject matter of which is incorporated herein by reference.

TECHNICAL FIELD

Aspects of the present invention relate to an image forming apparatus in which a photosensitive member and an exposing unit are placed in close proximity to each other.

BACKGROUND

An image forming apparatus includes plural photosensitive members to be exposed by plural exposing units such as Light Emitting Diode (LED) heads, respectively while placing the photosensitive members and light emitting faces of the plural exposing units in close proximity. In such an image forming apparatus, each of the exposing units is made movable between an exposing position where the exposing unit is close to the corresponding one of the photosensitive members, and a retracted position where they are separated from each other, thereby enabling the photosensitive member to be easily attached to and detached from a body of the image forming apparatus. At the exposing position where the exposing unit is close to the photosensitive member, in order to perform accurate exposure on the photosensitive member, the positional relationship between the photosensitive member and the exposing unit has to be kept constant. JP-A-2003-112446 describes an image forming apparatus in which an LED head is held by a cover, and a positioning of the LED head with respect to the photosensitive member is conducted by fitting a positioning projection into a positioning hole formed in an image drum unit holding a photosensitive member.

However, even when the image drum unit and the LED head are positioned by using the projection and the hole as in JP-A-2003-112446, adjacent LED heads cannot be positioned with respect to each other to be parallel.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus having plural exposing units, which allows positional relationships among the exposing units to be accurately determined.

According to an exemplary embodiment of the present invention, there is provided an image forming apparatus including: a plurality of photosensitive members; a plurality of exposing units which are opposed to the photosensitive members, respectively, each of the exposing units including a plurality of light emitting elements arranged in a first direction to expose a respective one of the photosensitive members; and a body frame which is provided at both sides of the exposing units in the first direction. Each of the exposing units includes: a gap maintaining member which abuts a respective one of the photosensitive members to define a distance between the exposing unit and the photosensitive member; a first-direction positioning portion which abuts the body frame in the first direction to position the exposing unit in the first direction; and a second-direction positioning portion which abuts the body frame in a second direction perpendicular to the first direction and an exposing direction of the light emitting elements, to position the exposing unit in the second direction.

According to another exemplary embodiment of the present invention, there is provided an image forming apparatus including: a photosensitive member; an exposing unit including an emitting portion including a plurality of light emitting elements arranged in a first direction to expose the photosensitive member, a gap maintaining member configured to abut the photosensitive member, and a positioning portion at both ends thereof in the first direction; and a body frame which is provided at both sides of the exposing unit in the first direction. The exposing unit is movable relative to the photosensitive member between an exposing position where the emitting portion is opposed to the photosensitive member with the gap maintaining member being between the exposing unit and the photosensitive member and a retracted position where the emitting portion is not opposed to the photosensitive member. The body frame includes a first urging member which urges the positioning portion in the first direction; and a second urging member which urges the positioning portion in a second direction perpendicular to the first direction.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Next, an exemplary embodiment of the present invention will be described in detail with reference to the drawings.

Figure 1:
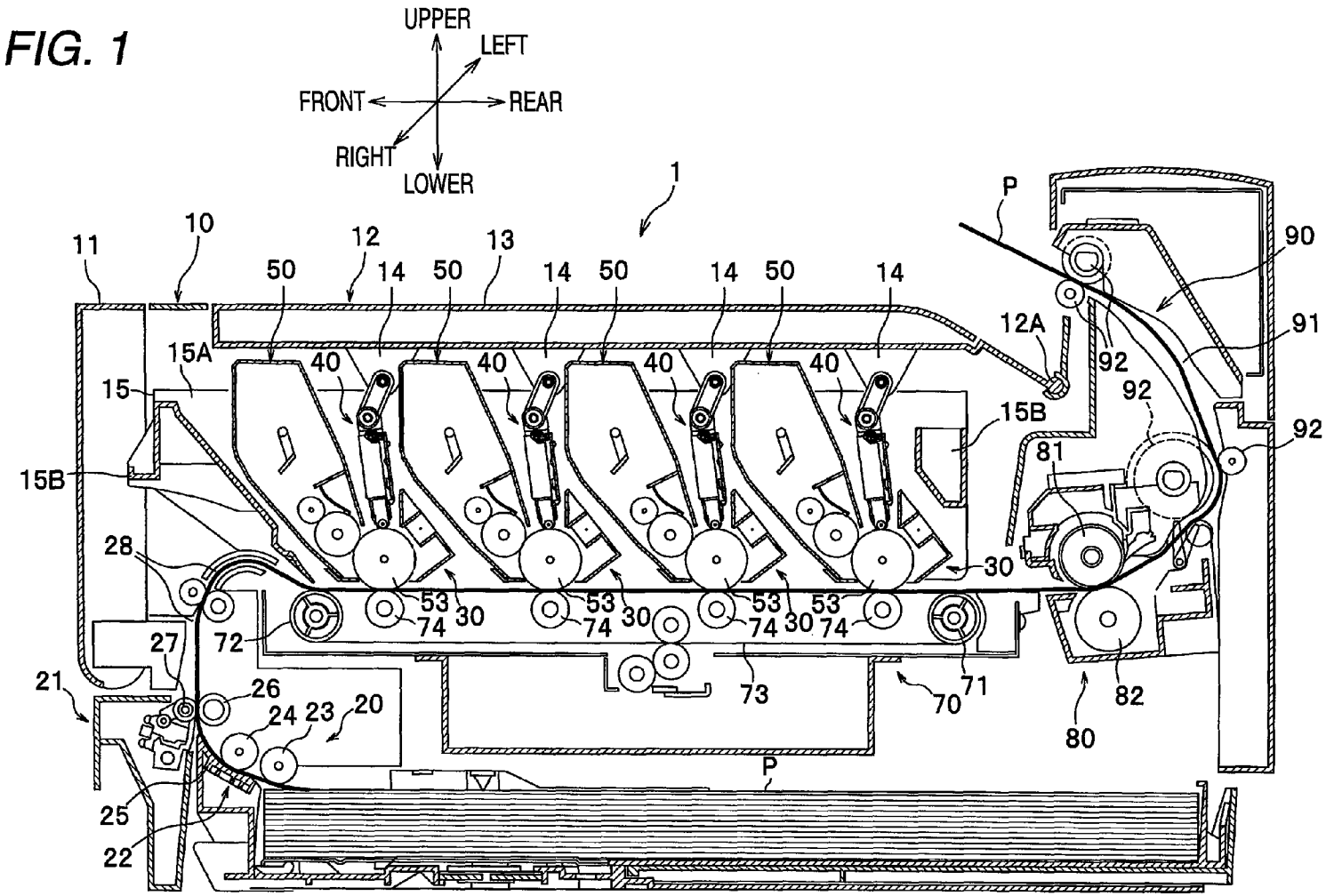
FIG. 1 is a section view showing the overall configuration of a color printer according to an exemplary embodiment of the present invention.
Figure 2:
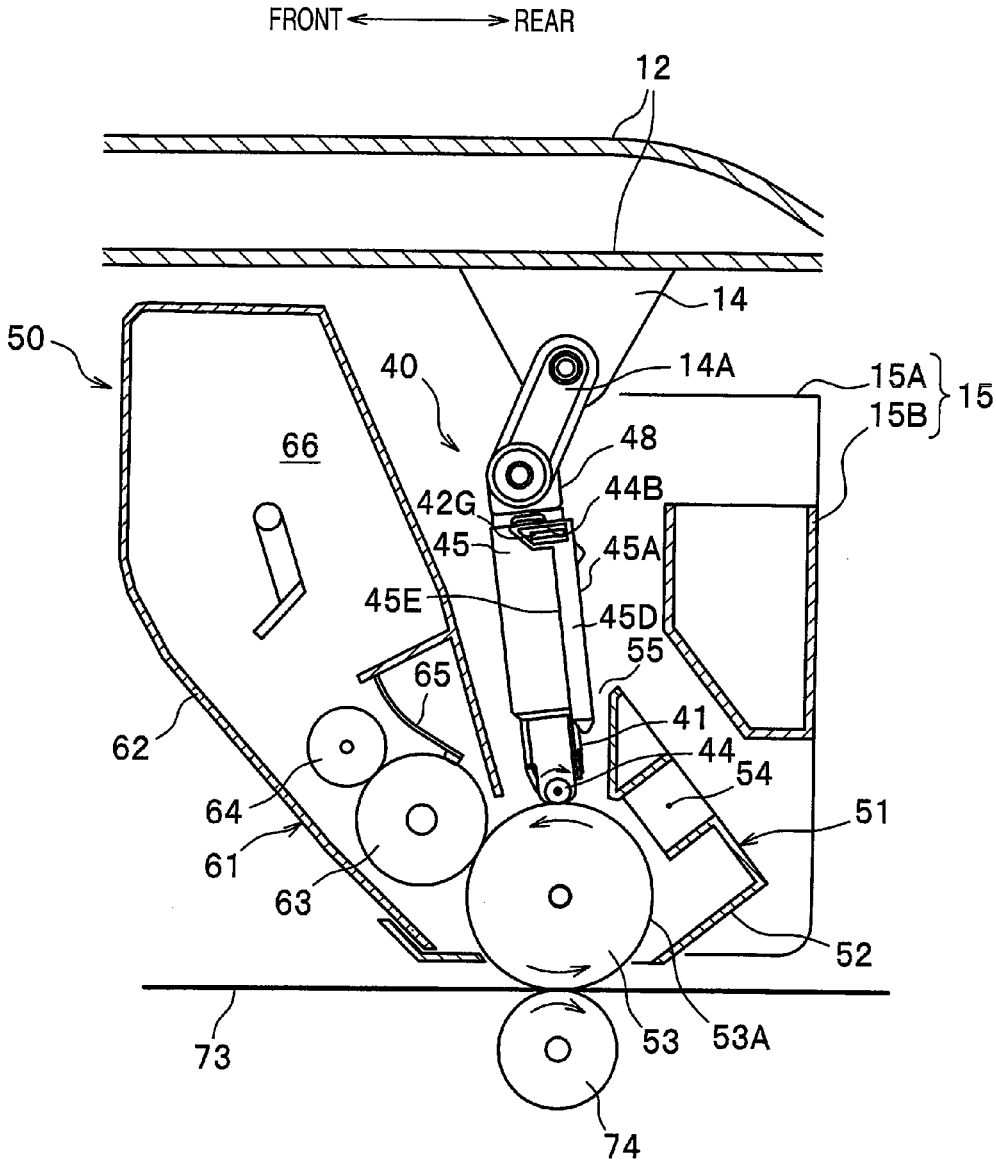
FIG. 2 is an enlarged view of an LED unit and a process cartridge shown in FIG. 1.
Figures 3A, 3B:
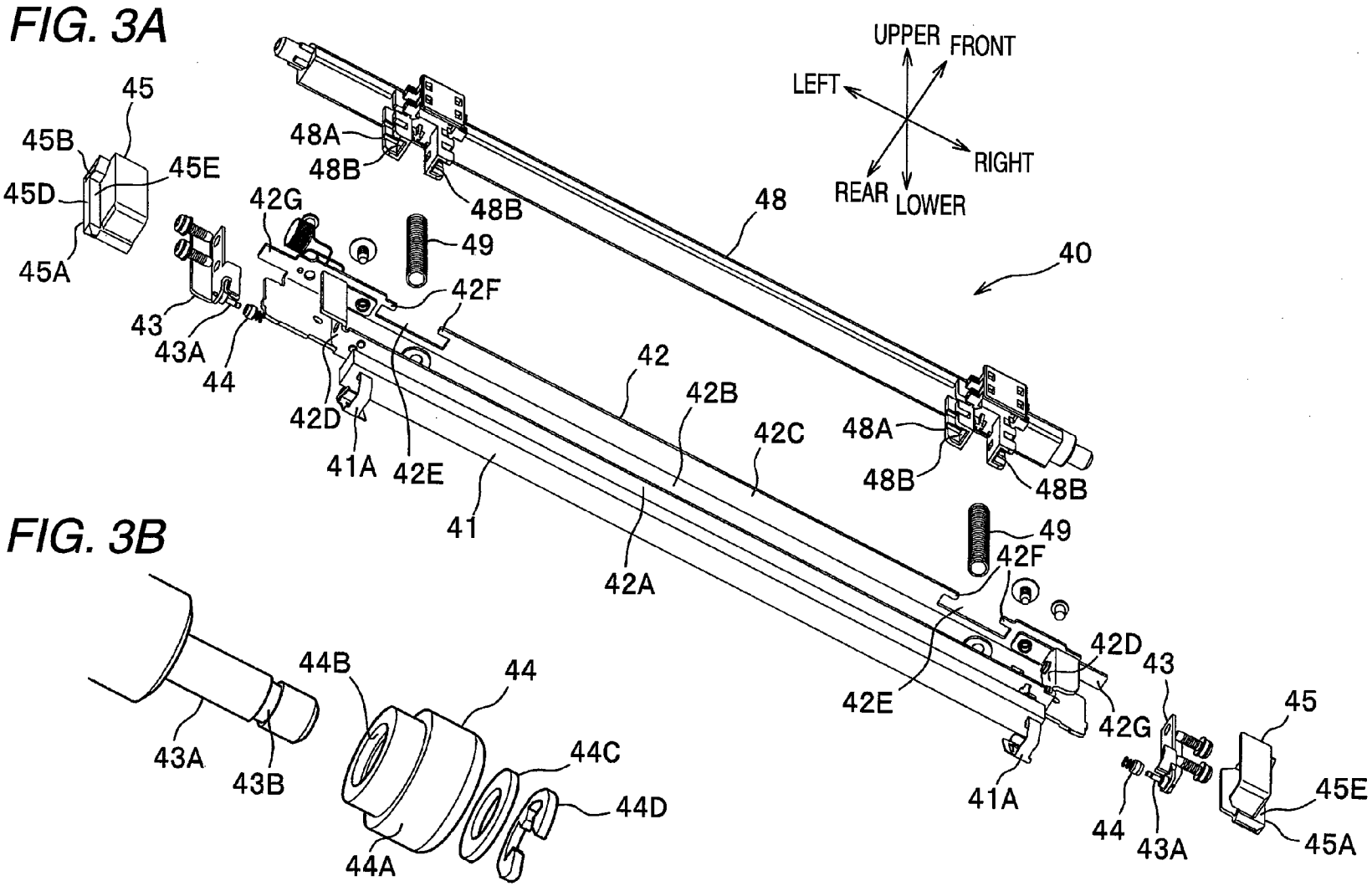
FIG. 3A is an exploded perspective view of the LED unit.
FIG. 3B is an enlarged perspective view of a guide roller.
Figure 4:
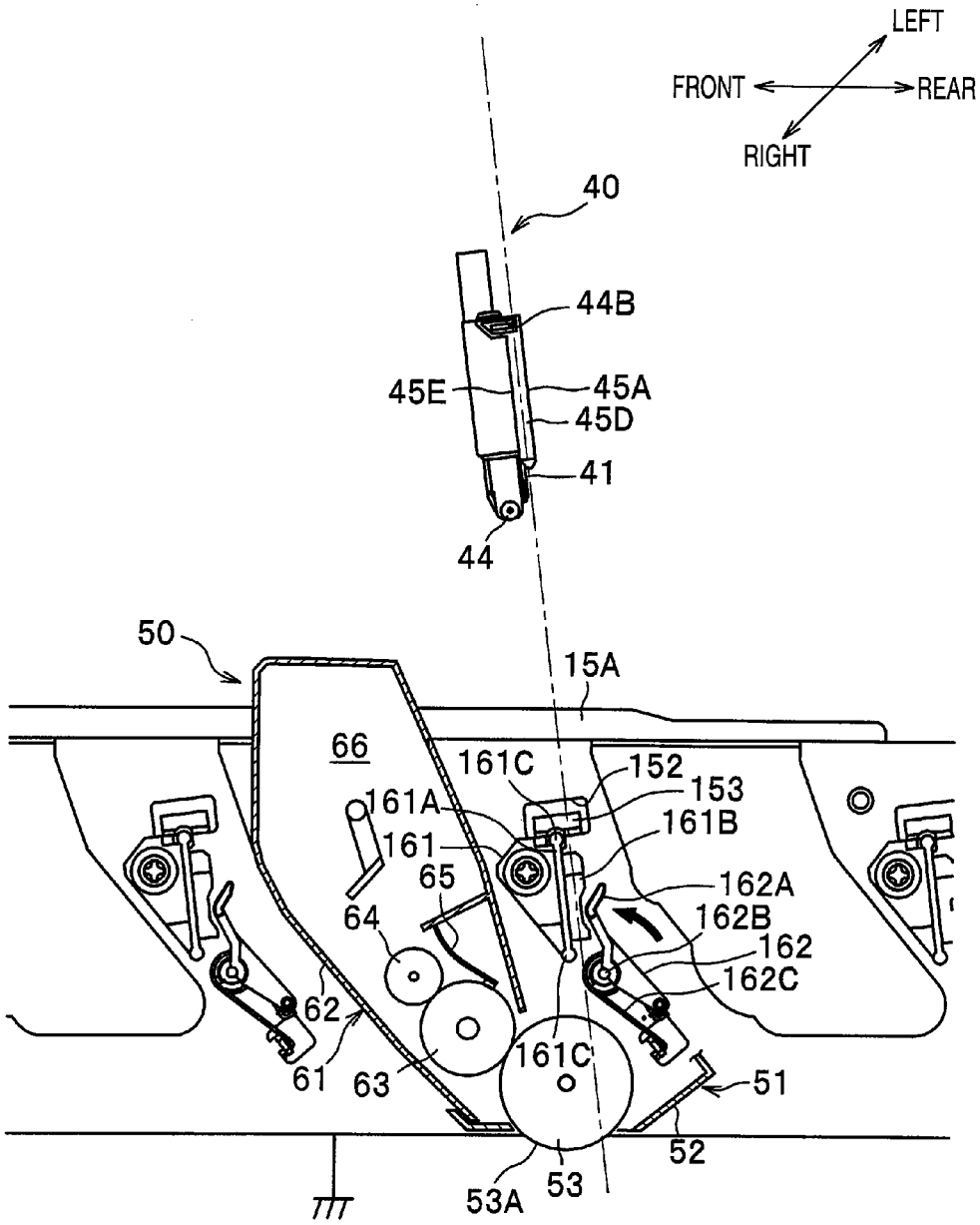
FIG. 4 is a side view showing the positional relationship between the LED unit and a side section of an exposure frame.
Figure 5:
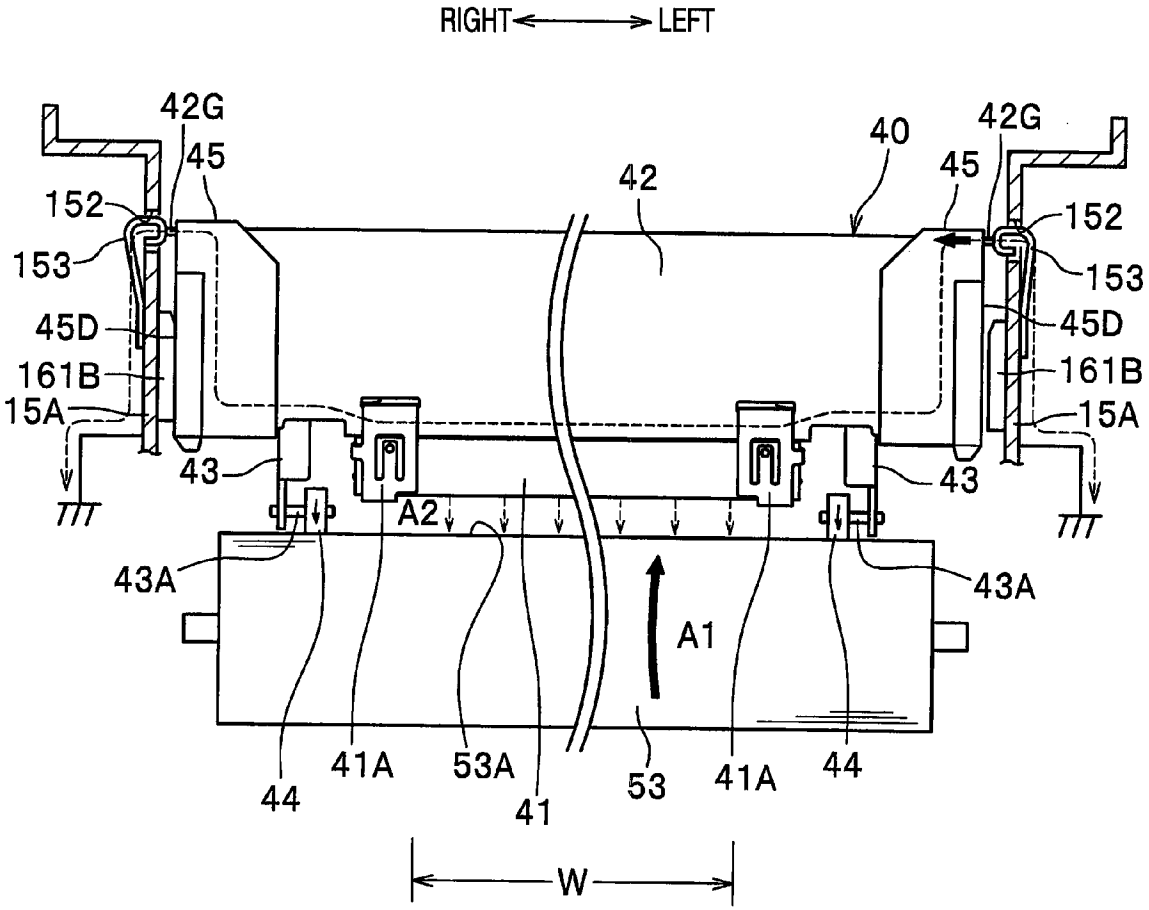
FIG. 5 is a view in which a photosensitive drum and the LED unit are seen from the rear side.

Among the drawings to be referred, FIG. 1 is a section view showing the overall configuration of a color printer, FIG. 2 is an enlarged view of an LED unit and process cartridge shown in FIG. 1, FIG. 3A is an exploded perspective view of the LED unit, FIG. 3B is an enlarged perspective view of a guide roller, FIG. 4 is a side view showing the positional relationship between the LED unit and a side section of an exposure frame, and FIG. 5 is a view in which a photosensitive drum and the LED unit are seen from the rear side.

In the following description, the indication of the direction will be made with reference to the user using the color printer. That is, in FIG. 1, it is assumed that when viewing the figure, the left side is "front side", the right side is "rear side", the back side is "left side", and the front side is "right side". Furthermore, it is assumed that the vertical direction when viewing the figure is "vertical (upper-lower) direction".

As shown in FIG. 1, the color printer 1 includes in a body case 10; a sheet feeding unit 20 which feeds a sheet P; an image forming unit 30 which forms an image on the fed sheet P; and a sheet discharging unit 90 which discharges the sheet P on which an image is formed.

In an upper portion of the body case 10, an upper cover 12 which is openable and closable with respect to the body case 10 is disposed to be vertically pivotable about a hinge 12A disposed at the rear side. The upper face of the upper cover 12 serves as a sheet discharging tray 13 on which sheets P discharged from the body case 10 is stacked, and. The lower face of the upper cover is provided with plural LED attaching members 14 for holding LED units 40 are provided, which will be described later.

A body frame 15 which detachably accommodates process cartridges 50 (described later) and which constitutes a part of the apparatus body is disposed in the body case 10. The body frame 15 includes a pair of metal side frames 15A which are disposed in the right and left sides (only one frame is shown), and a pair of front and rear cross members 15B which couple the pair of side frames 15A with each other. The body frame 15 is fixed to the body case 10 and the like. The side frames 15A are placed respectively on the both sides of an arrangement direction of light emitting elements of LED heads 41 which will be described later and directly or indirectly support and position the photosensitive drums 53. The direction along which the light emitting elements are arranged is referred to a main direction. In the exemplary embodiment, the direction coincides with an axial direction of each of the photosensitive drums 53.

The sheet feeding unit 20 includes: a sheet feeding tray 21 which is disposed in a lower portion of the body case 10, and which is detachably attached to the body case 10; and a sheet feeding mechanism 22 which conveys the sheet P from the sheet feeding tray 21 to the image forming unit 30. The sheet feeding mechanism 22 is disposed in front of the sheet feeding tray 21, and includes a feed roller 23, a separation roller 24, and a separation pad 25.

In thus configured sheet feeding unit 20, sheets P in the sheet feeding tray 21 are upwardly fed while being individually separated from one another, paper dusts are removed away during a process in which the sheet P is passed between a paper dust removing roller 26 and a pinch roller 27, and then the sheet is passed through a conveying path 28 to convert the direction of the sheet to the rearward direction, and fed to the image forming unit 30.

The image forming unit 30 includes four LED units 40, four process cartridges 50, a transferring unit 70, and a fixing unit 80.

The four process cartridges 50 are arranged in the longitudinal direction between the upper cover 12 and the sheet feeding unit 20. As shown in FIG. 2, each of the cartridges includes a drum unit 51, and a developing unit 61 which is detachably attached to the drum unit 51. The process cartridges 50 are supported by the side frames 15A, and the photosensitive drums 53 are supported by the process cartridges 50, respectively. The process cartridges 50 have the same configuration but are different with each other in colors of toners housed in respective toner housing chambers 66 of the developing units 61.

The drum unit 51 includes a drum frame 52, the photosensitive drum 53 which is rotatably supported by the drum frame 52, and a scorotron charger 54.

The developing unit 61 includes a developing frame 62, a developing roller 63 and supplying roller 64 which are rotatably supported by the developing frame 62, and a layer-thickness restricting blade 65, and has the toner housing chamber 66 which houses the toner. In the process cartridge 50, the developing unit 61 is attached to the drum unit 51, whereby an exposing space 55 through which the photosensitive drum 53 can be seen from the upper side is formed between the developing frame 62 and the drum frame 52. The LED unit is inserted through the exposing space 55.

As shown in FIG. 1, the transferring unit 70 is disposed between the sheet feeding unit 20 and the process cartridges 50. The transferring unit 70 includes a driving roller 71, a driven roller 72, a conveyor belt 73, and transfer rollers 74.

The driving roller 71 and the driven roller 72 are placed in parallel while being separated from each other in the longitudinal direction. The conveyor belt 73 configured by an endless belt is wound around the driving roller 71 and the driven roller 72. The outer surface of the conveyor belt 73 is in contact with the photosensitive drums 53. Inside the conveyor belt 73, four transfer rollers 74 which cooperate with the photosensitive drums 53 to sandwich the conveyor belt 73 are placed so as to be opposed to the respective photosensitive drums 53. During a transfer process, a transfer bias is applied to the transfer rollers 74 with a constant-current control.

The fixing unit 80 is placed rear side from the process cartridges 50 and the transferring unit 70, and includes a heating roller 81, and a pressing roller 82 which is opposed to the heating roller 81 to press the heating roller 81.

In thus configured image forming unit 30, first, the surface of each of the photosensitive drums 53 is uniformly charged by the scorotron charger 54, and then exposed by LED beams emitted from the corresponding LED unit 40. Therefore, the potential of the exposed portion is lowered, and an electrostatic latent image based on image data is formed on the photosensitive drum 53.

The toner in the toner housing chamber 66 is supplied to the developing roller 63 by rotation of the supplying roller 64, and caused by rotation of the developing roller 63 to enter between the developing roller 63 and the layer-thickness restricting blade 65 and carried on the developing roller 63 as a thin layer of a constant thickness.

When the developing roller 63 is opposed to and in contact with the photosensitive drum 53, the toner carried on the developing roller 63 is supplied to the electrostatic latent image formed on the photosensitive drum 53. Therefore, the toner is selectively carried on the photosensitive drum 53 to visualize the electrostatic latent image, and a toner image is formed by the reversal development.

Next, the sheet P fed onto the conveyor belt 73 is passed between the photosensitive drums 53 and the transfer rollers 74 placed inside the conveyor belt 73, so that the toner images formed on the photosensitive drums 53 are transferred to the sheet P.

When the sheet P is passed between the heating roller 81 and the pressing roller 82, the toner images transferred to the sheet P are thermally fixed thereto.

The sheet discharging unit 90 includes: a discharge conveying path 91 which is formed so as to upwardly extend from the outlet of the fixing unit 80, and to be then inverted toward the front side, and plural pairs of conveying rollers 92 which convey the sheet P. The sheet P onto which the toner images have been transferred, and which has undergone the thermal fixing process is conveyed through the discharge conveying path 91 by the conveying rollers 92, and then discharged to the outside of the body case 10 to be stacked on the sheet discharging tray 13.

<Configuration of LED Unit>

Next, the characteristic portions of the present invention, i.e., the LED units 40 and the configuration for positioning and grounding them will be described in detail.

Herein, the grounding a member refers to a state in which the member is electrically connected to the ground and also a state in which the member is electrically connected to a member having a large amount of capacitance such as the metal side frames 15A.

As shown in FIG. 3, each of the LED units 40 includes the LED head 41, an exposure frame 42, roller support members 43, guide rollers 44, resin covers 45, and a suspender 48.

The LED head 41 includes plural light emitting elements each configured by an LED arranged laterally in one row in the lower side. Specifically, the LED head 41 has a head configuration in which plural light emitting elements (LEDs) which are arranged in accordance with specific pixel pitches, and which are selectively driven to expose the surface of the photosensitive drum 53 are supported by a supporting member. Herein, the arrangement direction of the light emitting elements is referred to as the main direction, and the direction perpendicular to the main direction and perpendicular to the exposure direction (see an arrow A2 of FIG. 5) of the LEDs, specifically the longitudinal direction along which the photosensitive drums 53 are arranged is referred to as the sub direction. The LED head is longer in the main direction than in the sub direction. The exterior of the LED head 41 is formed by a resin, so that discharges from high-voltage components such as the scorotron charger 54 are suppressed. The light emitting elements receives a signal from a control device (not shown) on the basis of data of an image to be formed, and emits light to expose the photosensitive drum 53.

The exposure frame 42 supports the LED head 41. The exposure frame 42 is formed by pressing a metal plate into a substantially U-like section, and is electrically conductive. The exposure frame 42 is formed to be longer than the LED head 41 in the axial direction of the photosensitive drum 53, i.e., the lateral direction or the main direction. In other words, the exposure frame 42 protrudes from the LED head 41 at both sides in the main direction. Specifically, the exposure frame 42 includes a lower section 42A, a side section 42B, and an upper section 42C to configure one member extending in the lateral direction and having the U-like section. In the both ends of the lower section 42A in the lateral direction (hereinafter, the ends are referred to simply as "the both ends"), end sections 42D are formed by bending end portions of the lower section 42A. In the upper section 42C, openings 42E which are opened in the front side are formed in the vicinities of the both ends. In the front side or opening end of each of the openings 42E, engaging hooks 42F which laterally extend toward the inner side of the opening 42E so as to narrow the opening 42E are formed. The LED head 41 is fixed to the lower section 42A of the exposure frame 42 from the lower side of the exposure frame 42 by two clips 41A.

The both ends in the lateral direction of the upper section 42C of the exposure frame 42 outwardly project in the lateral direction to form grounding terminals 42G.

Each of the roller support member 43 is a bracket which is formed by press processing a conductive metal plate, and which is screwed to the corresponding one of the end sections 42D of the exposure frame 42. In the roller support member 43, a roller shaft 43A which laterally extends toward the inner side is disposed in the lower end. The roller shaft 43A rotatably supports the guide roller 44. As shown in FIG. 3B, an engaging groove 43B is formed in the circumference of the roller shaft 43A.

The guide roller 44 is a substantially cylindrical roller which is used for maintaining a gap between the LED head 41 and the photosensitive drum 53. Specifically, a rolling face 44A is formed into a cylindrical shape. A shaft hole 44B into which the roller shaft 43A is to be fitted is formed in the central axis of the rolling face 44A. The roller shaft 43A is passed through the shaft hole 44B, a washer 44C is inserted, and then a clip 44D is engaged with the engaging groove 43B, whereby the guide roller 44 is attached to the roller shaft 43A. That is, the extending direction of the roller shaft 43A coincides with the rotation axis direction of the guide roller 44.

As shown in FIG. 2, the guide roller 44 rolls while contacting with the peripheral face 53A of the photosensitive drum 53, to define the positional relationship between the LED unit 40 and the photosensitive drum 53, and specifically the gap between the light emitting elements of the LED head 41 and the peripheral face 53A. The material constituting the guide roller 44 is not particularly restricted. However, a material which has an adequate coefficient of friction with respect to the peripheral face 53A, and which has an excellent wear resistance, such as a polyamide resin may be used.

As shown in FIG. 5, in order to prevent the image formation from being influenced, the guide roller 44 is placed outside the image forming range W on the peripheral face 53A of the photosensitive drum 53, to which the toner is supplied.

The resin covers 45 cover metal portions in the both ends of the exposure frame 42. The resin covers 45 which are disposed respectively on the right and left sides are symmetrical. The resin covers 45 are configured by insulative resin members, and formed so as to cover the end faces of the exposure frame 42 and portions of a specific range from the both ends, respectively. Each of the resin covers 45 includes a guide rib 45A projecting outwardly from a lateral outer end portion and extending vertically. The upper end of the guide rib 45A has a substantially triangular profile as seen from the lateral end side. A through hole 45B is formed in the inner side of the triangular portion. The corresponding one of the grounding terminals 42G passes through the through hole 45B to be exposed therefrom.

Each of the lateral end faces of the guide ribs 45A has a main-direction positioning face 45D. The main-direction positioning faces 45D is configured to abut the side frame 15A in the main direction to position the LED unit 40 in the main direction. The front face of each of the guide rib 45A has a sub-direction positioning face 45E. The sub-direction positioning face 45E is configured to abut the side frame 15A in the sub direction to position the LED unit 40 in the sub direction.

The suspender 48 supports the exposure frame 42 and the LED head 41 in a suspended state. The suspender 48 is formed so that the lateral length is equal to that of the exposure frame 42. The suspender includes an engaging member 48A disposed at two positions respectively corresponding to the two openings 42E. Each of the engaging members 48A includes a portions which has a U-like section shape, and which are opened to the laterally outer side as seen from the lower side. A opening 48B of the U-like section is loosely engaged with the corresponding engaging hook 42F.

Compression springs 49 are placed between the engaging members 48A and the exposure frame 42, respectively. The compression springs 49 are placed laterally inside the respective two guide rollers 44. After the engaging members 48A are loosely engaged with the openings 42E and engaging hooks 42F of the exposure frame 42, they are locked by locking members which are not shown, and then the exposure frame 42 and the LED head 41 are always downwardly urged by the compression springs 49.

As shown in FIG. 2, the LED unit 40 is attached to the upper cover 12 through a connecting link 14A and an LED attaching member 14. In connecting portions between the connecting link 14A, and the LED attaching member 14 and the LED unit 40, the connecting link is pivotable in a side view of FIG. 2. According to this configuration, the posture of the LED unit 40 can be freely changed. Therefore, the LED unit 40 can be easily engaged with the side frames 15A.

In the state where the LED unit 40 is attached to the upper cover 12, the LED unit downwardly extends from the upper cover 12. As described above, since the upper cover 12 is pivotable about the hinge 12A of the rear side so as to be openable and closable, the photosensitive drum 53 and the LED unit 40 can be relatively moved between an exposing position where the photosensitive drum 53 and the LED unit 40 are close to each other (opposed to each other), and a retracted position where the photosensitive drum 53 and the LED unit 40 are separated from each other. In the LED unit 40, at the exposing position, the guide rollers 44 disposed in the lower end abuts the upper end of the peripheral face 53A of the photosensitive drum 53, whereby the distance between the peripheral face 53A and the LED head 41 is kept constant.

As shown in FIG. 4, each of the side frames 15A has a front guide 161 and a rear guide 162 correspondingly to the end portion of each of the four LED units 40 at the exposing position. The front guide 161 is placed in front of the sub-direction positioning face 45E, and the rear guide 162 is placed behind the sub-direction positioning face 45E.

In the front guide 161 includes a rib 161A projecting laterally inwardly and extending substantially vertically. When the LED unit 40 is mounted to take the exposing position, the rib 161A is positioned in front of the guide rib 45A. The rib 161A includes columnar portions 161C at upper and lower end portions thereof. Each of the columnar portions 161C has a columnar shape which is laterally thicker than a middle portion of the rib 161A. The columnar portions 161C abut the sub-direction positioning face 45E to position the LED unit 40 in the sub direction. The front guide 161 includes an abutting portion 161B provided on the rear edge thereof along the rib 161A. The abutting portion 161B has a face which the main-direction positioning face 45D of the LED unit 40 abuts. A right-side abutting portion 161B abuts the LED unit 40 at one end to restrict the lateral position of the LED unit 40.

An arm 162A which extends from the lower side toward the upper side is disposed on the rear guide 162. The arm 162A is pivotably supported at a shaft 162B by a metal plate of the side frame 15A. A torsion spring 162C is disposed in the periphery of the shaft 162B so that an urging force in a counterclockwise direction in FIG. 4 is always applied to the arm 162A by the torsion spring 162C.

Both the front and rear guides 161, 162 are made of a resin, whereby abrasion due to sliding contact with the LED unit 40 is suppressed.

In each of the side frames 15A, an opening 152 corresponding to the grounding terminal 42G of the LED unit 40 at the exposing position is formed substantially above the abutting portion 161B. As shown in FIG. 5, a plate spring 153 which is formed by bending a conductive metal plate is disposed in the opening 152. The plate spring 153 abuts the grounding terminal 42G of the LED unit 40 so that the plate spring 153 is bent to generate an urging force in the lateral inner direction. The plate spring 153 at the left side (the right one in FIG. 5) is thicker than the plate spring 153 at the right side (the left one in FIG. 5) so as to exert a larger urging force. As shown in FIGS. 4 and 5, the side frames 15A are electrically grounded.

Figure 6:
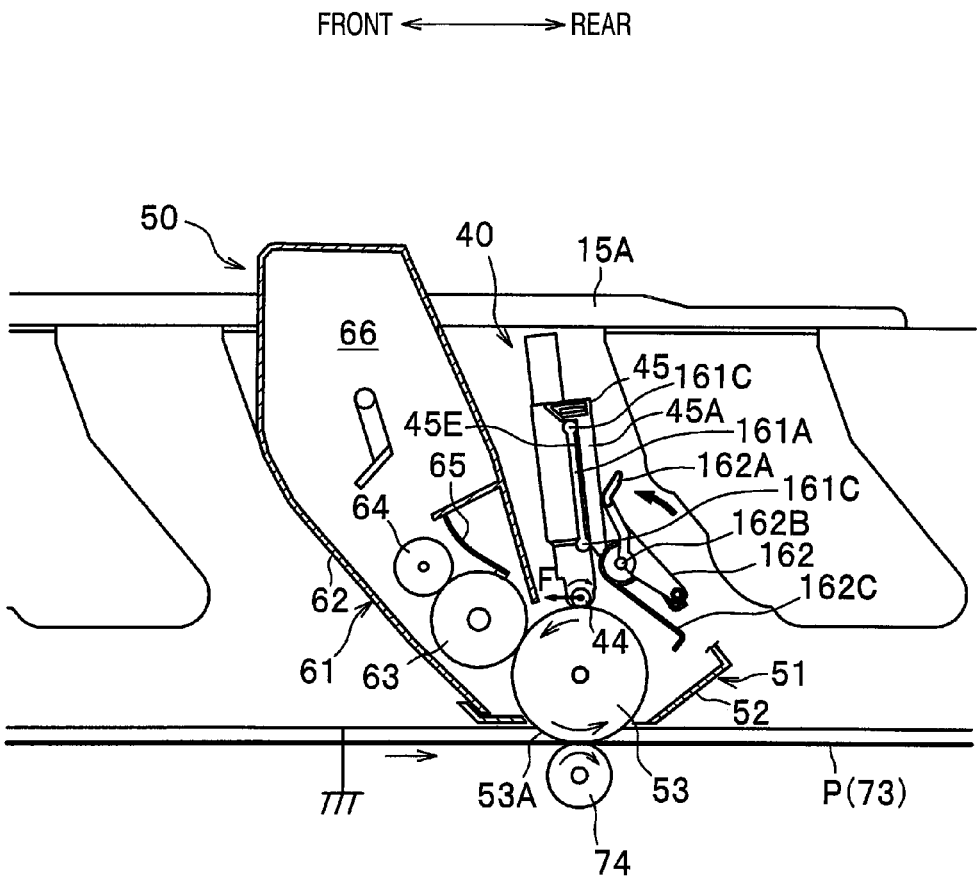
FIG. 6 is a view illustrating the positioning in a sub direction in the case where the LED unit is positioned at an exposing position.

The operation and effect of the thus configured color printer 1 according to the exemplary embodiment of the present invention will be described below. In the figures to be referred, FIG. 6 is a view illustrating the positioning in the sub direction in the case where the LED unit is positioned at the exposing position. In FIG. 6, in order to illustrate the engagement state between the front guides 161 (the ribs 161A) and the LED unit 40 and the engagement state between the rear guides 162 and the LED unit 40, the components are schematically shown in a manner different from the actually viewed state.

When one of the process cartridges 50 of the color printer 1 is to be replaced or on a maintenance process, the upper cover 12 is upwardly pivoted to the open position, and the corresponding LED unit 40 is then moved from the exposing position to the retracted position.

In the color printer 1 of the exemplary embodiment, the LED unit 40 is movable between the exposing position and the retracted position with respect to the photosensitive drum 53 in this way. Therefore the LED unit 40 has to be positioned with respect to the photosensitive drum 53.

When the maintenance is finished, the upper cover 12 is downwardly pivoted to the close position. At this time, as shown in FIG. 2, the guide rollers 44 which are at the tip end (lower end) of the LED unit 40 abut the peripheral face 53A of the photosensitive drum 53, whereby the distance between the peripheral face 53A and the light emitting elements of the LED head 41 is kept constant.

In the LED unit 40 inserted to the exposing position, as shown in FIG. 5, the right and left grounding terminals 42G abut the respective plate springs 153, and are urged laterally inwardly from the both sides. Since the urging force of the left plate spring 153 is larger than that of the right plate spring 153, the LED unit 40 is shifted rightwardly as a whole, and the right abutting portion 161B abuts the right main-direction positioning face 45D, so that the LED unit 40 is positioned in the main direction.

In this way, the LED units 40 are positioned in the main direction with reference to the side frames 15A which constitute a part of the body frame 15. Therefore, the LED units 40 are positioned in accordance with the positional relationships with respect to the body frame 15, and the positional relationships among the LED units 40 in the main direction can be accurately determined.

As shown in FIG. 6, the guide rib 45A is inserted between the ribs 161A and the arms 162A. The arm 162A is pivoted about the shaft 162B by the torsion spring 162C, and urged in a counterclockwise direction in FIG. 6, i.e., in the forward direction, so that the guide rib 45A is forwardly urged. According to this configuration, the sub-direction positioning faces 45E of the guide ribs 45A abuts the columnar portions 161C at the both ends of the ribs 161A, thereby positioning the LED unit 40 in the sub direction with reference to the side frames 15A which constitute a part of the body frame 15. Therefore, the LED units 40 are positioned in accordance with the positional relationship with respect to the body frame 15, and the positional relationships among the LED units 40 in the sub direction can be accurately determined.

When image formation is started in the color printer 1, as shown in FIG. 6, the sheet P is conveyed from the front side toward the rear side by the conveyor belt 73, and, in synchronization with the conveyance, each of the photosensitive drum 53 rotates in a counterclockwise direction in FIG. 6. Each of the guide rollers 44 is in contact with the photosensitive drum 53 and rotates in a clockwise direction in FIG. 6.

When the guide roller 44 receives a driving force from the photosensitive drum 53, an urging force F in the direction from the rear side to the front side is received. In the color printer 1 of the exemplary embodiment, a direction of the urging force F coincides with a direction of the urging force which is applied to the LED unit 40 by the torsion spring 162C. Therefore, during the image formation, the force which is applied from the photosensitive drum 53 does not counteract the urging force by the torsion spring 162C for the sub-direction positioning, and the position of the LED unit 40 in the sub direction is stabilized.

The both right and left plate springs 153 abut the grounding terminals 42G, and the side frames 15A having the plate springs 153 are electrically grounded. Therefore, the LED unit 40 is electrically grounded. Specifically, although the LED head 41 has the resin exterior, the LED head is grounded through the metal exposure frame 42 and further through the grounding terminals 42G, the plate springs 153, and the side frames 15A. Therefore, unwanted electromagnetic waves which may be possibly generated from the LED head 41 are absorbed, so that influences which are exerted on surrounding devices can be suppressed. Furthermore, since the exterior of the LED head 41 can be formed by a resin, the LED head 41 itself can be miniaturized, and the degree of freedom in the layout around the photosensitive drum 53 is enhanced, whereby the size of the color printer 1 can be reduced.

While the present invention has been shown and described with reference to certain exemplary embodiments thereof, it will be understood by those skilled in the art that various changes in form and details may be made therein without departing from the spirit and scope of the invention as defined by the appended claims.

Figure 7B:
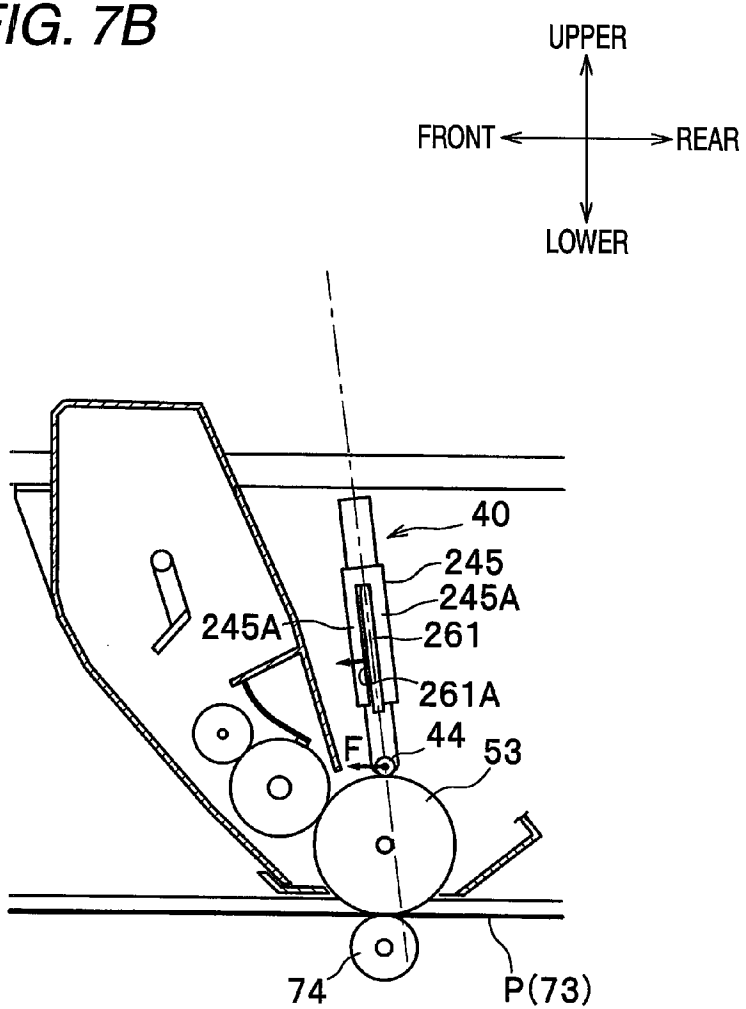
FIG. 7B is a view showing an exposing position in the another configuration.
Figure 7A:
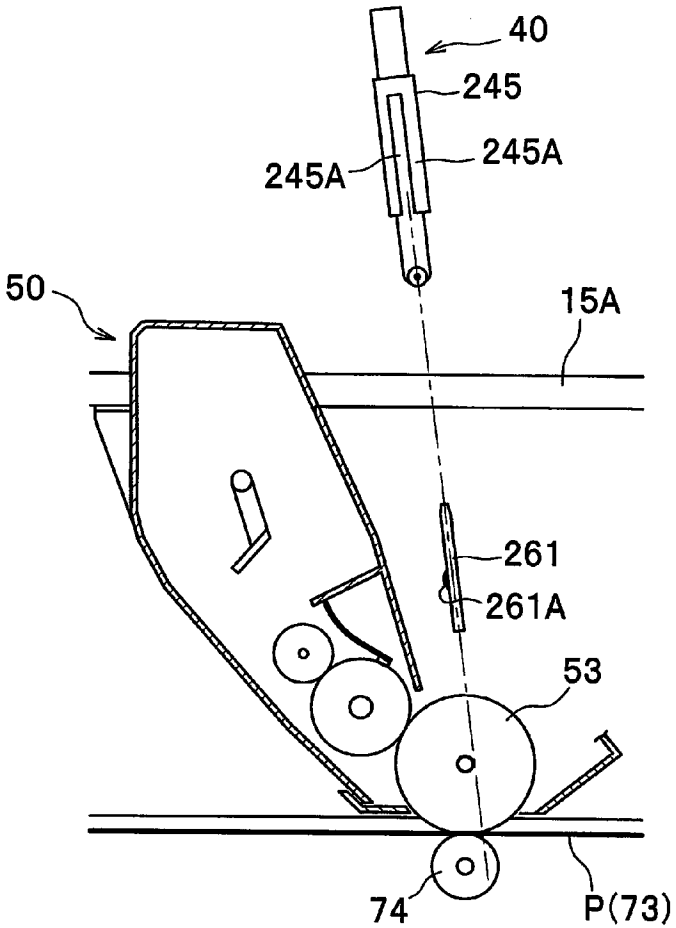
FIG. 7A is a view showing a retracted position in an example of another configuration where the LED unit is positioned in the sub direction.

For example, FIGS. 7A and 7B are views of an example of another configuration for positioning the LED unit in the sub direction. In FIG. 7, the positional relationship of the components are diagrammatically shown in a manner different from the actually viewed state. The components which are not described below are configured in the same manner as the above-described exemplary embodiment.

In the configuration shown in FIG. 7A, a resin cover 245 of the exposure frame 42 has two parallel guide ribs 245A which extends vertically. each of the side frames 15A has one assembly guide 261 which extends vertically. The assembly guide 261 has a plate spring 261A which slightly inflates toward the front side.

Also in this configuration, when the LED unit 40 is positioned at the exposing position as shown in FIG. 7B, the assembly guide 261 is inserted between the two guide ribs 245A, and the plate spring 261A abuts the rear face of the front guide rib 245A to forwardly urge the LED unit 40. This causes the rear face of the assembly guide 261 and the front face of the rear guide rib 245A to abut each other, so that the LED unit 40 is positioned in the sub direction. Therefore, similarly to the above-described exemplary embodiment, the LED units 40 are positioned in accordance with the positional relationship with respect to the body frame 15, and the positional relationship among the LED units 40 in the sub direction can be accurately determined.

In this configuration, the direction in which the plate spring 261A urges the LED unit 40 coincides with that of the urging force F which is applied to the LED unit 40 by the photosensitive drum 53. Therefore, during the image formation, the force which is applied from the photosensitive drum 53 does not counteract the urging force due to the plate spring 261A for the sub-direction positioning, and the position of the LED unit 40 in the sub direction is stabilized.

In the above-described exemplary embodiment, the first urging member is configured by the plate spring 153 which presses the LED unit 40. Alternatively, a springs which pulls the LED unit 40 may be used.

Figure 8:
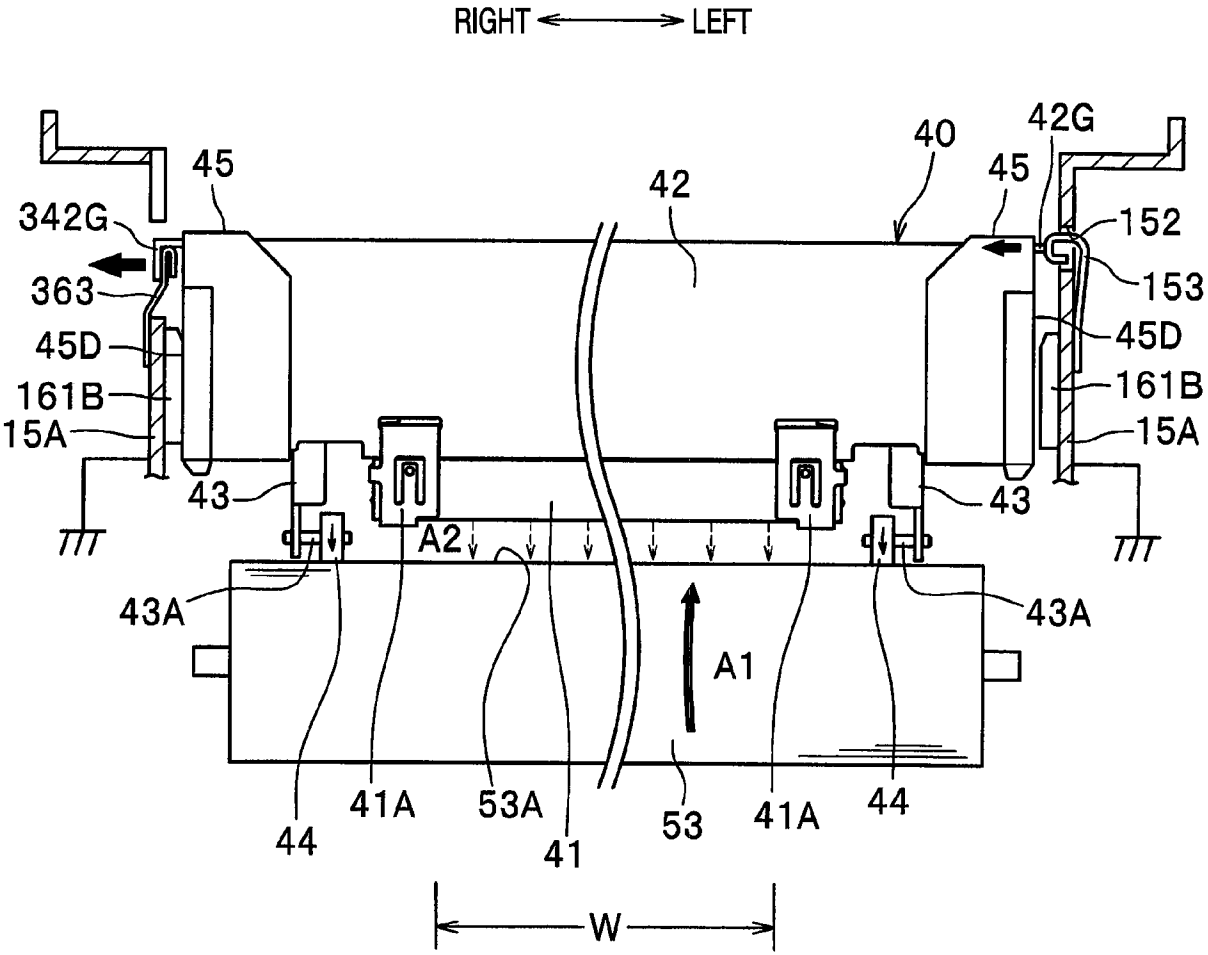
FIG. 8 is a view showing a modification in which positioning in a main direction is performed by a pull spring.

As shown in FIG. 8, for example, a plate spring 363 which is fixed to one of the side frame 15A, and which upwardly extends is disposed. By contrast, a grounding terminal 342G has a shape which is downwardly bent. In a grounding terminal 342G, the portion which downwardly extends is configured so that, when the LED unit 40 is lowered to be positioned at the exposing position, it is positioned laterally outside the plate spring 363. In this case, when the plate spring 363 pulls the LED unit 40, the abutting portion 161B abuts the main-direction positioning face 45D of the resin cover 45, and the LED unit 40 is positioned in the main direction.

According to this configuration, forces which are applied to the right and left side frames 15A can be reduced, and the side frames 15A are prevented from being bent laterally outwardly. Specifically, the left plate spring 153 of the push type is omitted or formed so as to exert a very weak force, and the LED unit 40 is shifted toward the right side by pulling mainly by the right plate spring 363, whereby the flexure of the side frames 15A can be suppressed. As a result, reinforcement of the side frames 15A can be reduced, and the color printer 1 can be lightened.

Figure 9:
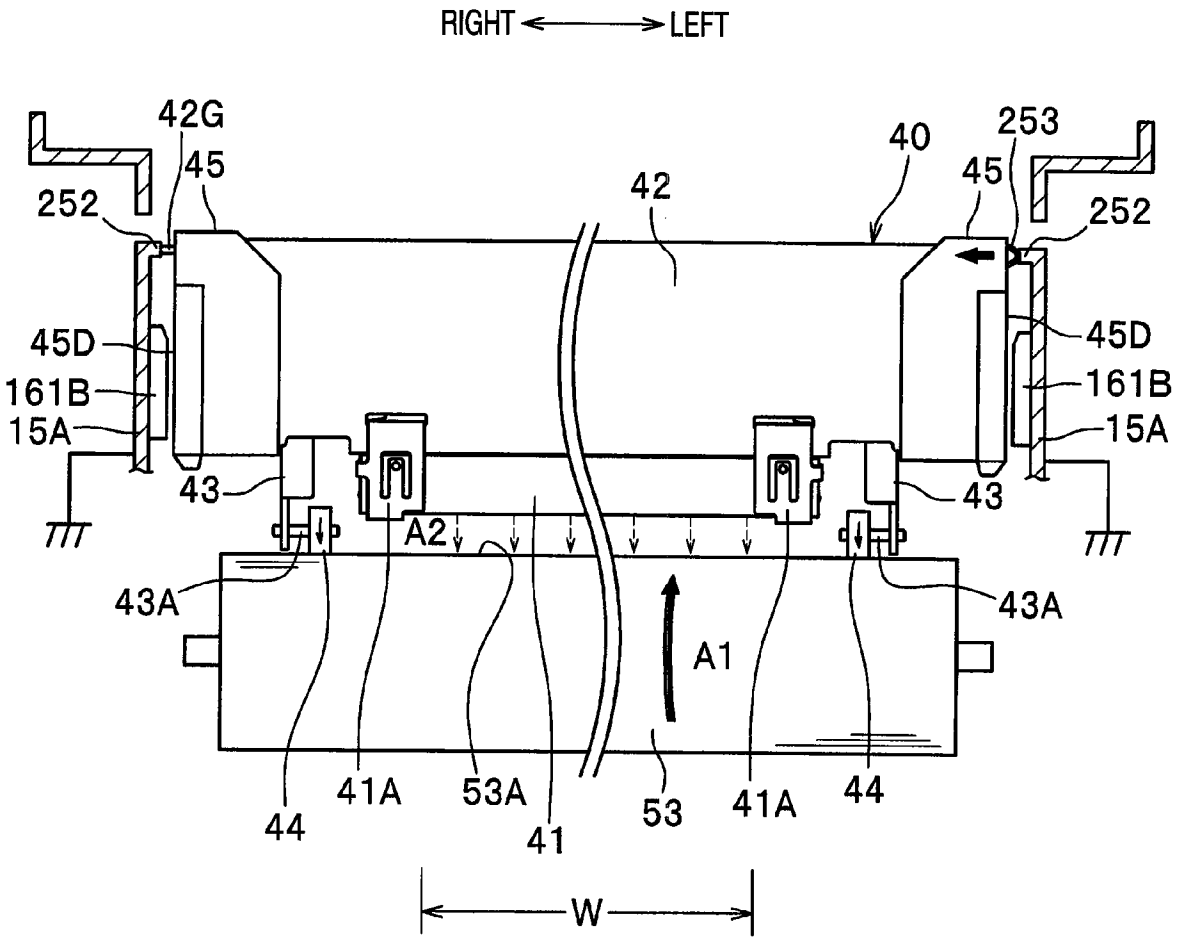
FIG. 9 is a view of an example in which a mechanism of positioning in the main direction is changed, and which corresponds to FIG. 5.

The mechanism of positioning in the main direction may be changed. FIG. 9 is a view of an example in which the mechanism of positioning in the main direction is changed, and which corresponds to FIG. 5. The components which are not described below are configured in the same manner as the above-described exemplary embodiment. In the example of FIG. 9, the plate spring 153 on the right side (the left side in FIG. 7) is omitted, and the side frame 15A is bent laterally inwardly, so that an abutting portion 252 is formed at a position corresponding to the grounding terminal 42G. Moreover, the plate spring 153 on the left side (the right side in FIG. 7) is omitted, an abutting portion 252 is formed in the same manner as the right side, and a metal plate spring 253 which is attached to the exposure frame 42, and which is outwardly projected from the through hole 45B is disposed. In this configuration, the LED unit 40 is rightwardly urged by the urging force of the plate spring 253, so that the positioning in the main direction is performed, and at the same time grounding of the LED head 41 is ensured. Specifically, in the right side, the LED unit 40 is grounded via the exposure frame 42, the grounding terminal 42G and the abutting portion 252, and, in the left side, the LED unit is grounded via the exposure frame 42 the plate spring 253 and the abutting portion 252.

In the exemplary embodiment described above, plural LEDs as the plural light emitting elements are described. In order to configure the plural light emitting elements, alternatively, only one light emitting element such as an LED may be used. For example, one back light such as a fluorescent lamp may be provided, and an optical shutter in which liquid crystal devices or PLZT elements are laterally arranged in one row may be disposed in front of the back light. That is, the plural light emitting elements which are laterally arranged in one row can be configured by combining a single light emitting element and the optical shutter arranged in a row. The light emitting elements may be laterally arranged not only in one row, but may be arranged in plural rows. The light emitting elements are not restricted to LEDs, and may be organic electroluminescence diodes (OLEDs), fluorescence elements, or the like.

The side frames 15A (the body frame 15) which are placed on the both sides of the photosensitive drum 53 may be configured by frames themselves of the color printer 1. Further, if the color printer 1 is provided with a drawer which removably mounts thereon the plural process cartridges 50 and is drawable to outside from the color printer 1, frames of the drawer may serve as the side frames 15A according to the exemplary embodiment. In this case, an openable and closable front cover 11 may be disposed in front of the body case 10 so as to be pivotable about the lower side in front and rear direction.

Although, in the exemplary embodiment, the guide rollers 44 is used for maintaining the gap between a photosensitive drum 53 and a LED head 41, this is not limited thereto. A member which slidably contacts the photosensitive drum 53 may be used. However, in the case where rollers are used as in the exemplary embodiment, abrasion due to slide contact with the photosensitive drum 53 can be prevented from occurring, and the distance between the photosensitive drum 53 and the LED head 41 can be easily kept constant.

Although, in the exemplary embodiment, the photosensitive drum 53 is employed as a photosensitive member, the present invention is not limited to this. Alternatively, a belt-like photosensitive member may be employed.

In the exemplary embodiment, the LED unit 40 is held by the upper cover 12, and configured so as to be relatively movable with respect to the body frame 15 in conjunction with opening and closing of the upper cover 12. Alternatively, the LED unit 40 may be fixed to the body frame so as to be immovable. However, in the case where the LED unit is held to a cover which is relatively movable with respect to the body frame 15, the process cartridge 50 can be easily replaced from the upper side.

What is claimed is:

1. An image forming apparatus comprising:
a photosensitive drum defining an axis line;
an exposure unit including:
a recess,
a plurality of light emitting elements aligned along a predetermined direction parallel to the axis line of the photosensitive drum,
a first end portion, and
a second end portion opposite to the first end portion in the predetermined direction, and being configured to expose the photosensitive drum;
a first frame provided adjacent to the first end portion of the exposure unit and having a contact portion configured to position the exposure unit in the predetermined direction, the contact portion being in contact with the first end portion of the exposure unit in the predetermined direction parallel to the axis line of the photosensitive drum;
a second frame provided adjacent to the second end portion of the exposure unit, the exposure unit being disposed between the first frame and the second frame in the predetermined direction parallel to the axis line of the photosensitive drum; and
a plate spring provided on the first frame, the plate spring including a pressing portion which presses the first end portion of the exposure unit against the contact portion, the plate spring having a fixed portion which is fixed to the first frame, the pressing portion engaging the recess of the exposure unit and pressing the first end portion in a direction along the predetermined direction from the second end portion of the exposure unit toward the first end portion of the exposure unit,
wherein the fixed portion of the plate spring is farther from the second frame than the pressing portion of the plate spring.

2. The image forming apparatus according to claim 1, wherein the plate spring has a connecting portion connecting the pressing portion and the fixed portion, the connecting portion being angled relative to the pressing portion and the fixed portion.

3. The image forming apparatus according to claim 2, wherein the first frame has:
a first side; and
a second side opposite to the first side in the predetermined direction, the second side being farther from the second frame than the first side,
wherein the fixed portion of the plate spring is fixed to the second side of the first frame.

4. The image forming apparatus according to claim 3, wherein the first side of the first frame is provided with the contact portion.

5. The image forming apparatus according to claim 4, wherein the contact portion protrudes relative to the first side of the first frame.

6. The image forming apparatus according to claim 1, wherein the pressing portion of the plate spring has a hook shape.

7. The image forming apparatus according to claim 1, wherein the pressing portion of the plate spring is farther from the axis line of the photosensitive drum than the fixed portion of the first frame.

8. An image forming apparatus comprising:
a photosensitive body rotatable about an rotational axis;
an exposure unit including a plurality of light emitting elements;
a first wall having a contact portion;
a second wall, the second wall being closer to the photosensitive body than to the first wall, the first wall being closer to the photosensitive body than to the second wall; and
a spring including:
a first portion which engages with the exposure unit and pulls the exposure unit against the contact portion of the first wall, and
a second portion which is fixed to the first wall,
wherein the second portion of the spring is farther from the second wall than the first portion of the spring.

9. The image forming apparatus according to claim 8, wherein the spring has a connecting portion connecting the first portion and the second portion, the connecting portion being angled relative to the first portion and the second portion.

10. The image forming apparatus according to claim 9, wherein the first wall has:
a first side; and
a second side opposite to the first side, the second side being farther from the second wall than the first side,
wherein the second portion of the spring is fixed to the second side of the first wall.

11. The image forming apparatus according to claim 10, wherein the first side of the first wall is provided with the contact portion.

12. The image forming apparatus according to claim 11, wherein the contact portion protrudes relative to the first side of the first wall.

13. The image forming apparatus according to claim 9, wherein the first portion of the spring is farther from the rotational axis of the photosensitive body than the second portion of the first wall.

14. An image forming apparatus comprising:

a photosensitive body rotatable about an rotational axis;

a LED unit including:

a plurality of light emitting elements;

a first side frame having a positioning portion;

a second side frame, the second side frame being closer to the LED unit than to the first side frame, the first side frame being closer to the LED unit than to the second side frame; and a metal plate including:

a first portion which pulls the LED unit toward the positioning portion of the first side frame, and a second portion which is fixed to the first side frame, wherein the second portion of the metal plate is farther from the second side frame than the first portion of the metal plate.

15. The image forming apparatus according to claim 14, wherein the metal plate has a connecting portion connecting the first portion and the second portion, the connecting portion being angled relative to the first portion and the second portion.

16. The image forming apparatus according to claim 15, wherein the first side frame has:

a first side; and a second side opposite to the first side, the second side being farther from the second side frame than the first side, wherein the second portion of the metal plate is fixed to the second side of the first side frame.

17. The image forming apparatus according to claim 16, wherein the first side of the first frame is provided with the positioning portion.

18. The image forming apparatus according to claim 17, wherein the positioning portion protrudes relative to the first side of the first side frame.

19. The image forming apparatus according to claim 14, wherein the first portion of the metal plate is farther from the rotational axis of the photosensitive body than the second portion of the first side frame.

20. The image forming apparatus according to claim 14, wherein an imaginary plane passing through the LED unit and perpendicular to the rotational axis of the photosensitive body is disposed between the first side frame and the second side frame.

* * * * *